US005333890A

United States Patent [19]

Bejean

[11] Patent Number: 5,333,890

[45] Date of Patent: Aug. 2, 1994

[54] PROCESS OF MANUFACTURING A SKI AND A SKI PRODUCED BY THE PROCESS

[75] Inventor: Alain Bejean, La Clusaz, France

[73] Assignee: Salomon S.A., Annecy Cedex, France

[21] Appl. No.: 497,353

[22] Filed: Mar. 22, 1990

[30] Foreign Application Priority Data

Mar. 23, 1989 [FR] France ..... 89 03851

[51] Int. Cl.[5] ..... A63C 5/00

[52] U.S. Cl. ..... 280/609; 280/610

[58] Field of Search ..... 280/601, 602, 609, 610, 280/614, 615

[56] References Cited

U.S. PATENT DOCUMENTS 3,635,484 1/1972 Nakamura et al. ..... 280/610
3,894,745 7/1975 Heim et al. ..... 280/610
4,911,462 11/1955 Diard et al. ..... 280/607

FOREIGN PATENT DOCUMENTS 2020812 7/1970 France .
2137893 12/1972 France .
2610525 8/1988 France .
8705525 9/1987 World Int. Prop. O. .

*Primary Examiner*—Richard M. Camby
*Attorney, Agent, or Firm*—Sandler, Greenblum & Bernstein

[57] ABSTRACT

A ski and a method of forming a ski. The ski includes a lower element and an upper element, each having the shape of a beam casing. The lower element has an upper surface that has either a longitudinally extending groove or a longitudinally extending projection and the upper element has a lower surface that has a groove or a projection that has a transverse cross-section that is respectively complementary to a transverse cross-section of the groove or to a transverse cross-section of the projection of the lower element, and in which the groove or projection of the lower element is nested in the projection or groove, respectively, of the upper element. Depending upon the nature of the desired response characteristics of the ski, the interior of the upper and lower elements can be selectively filled with specific materials or left empty.

37 Claims, 1 Drawing Sheet

PROCESS OF MANUFACTURING A SKI AND A SKI PRODUCED BY THE PROCESS

BACKGROUND OF THE INVENTION

Field of the Invention

The present invention relates to a process for manufacturing a ski, as well as a ski obtained by such a process.

Description of Background and Other Information

The manufacture of skis has evolved over time and, during such evolution, various types of skis have been known to be made from a variety of different materials. Initially, skis were made of wood. Subsequently, metallic skis were introduced and, recently, skis have been made from plastic materials. Skis made of plastic materials which are manufactured by molding, forming, or injection are significant in particular because such manufacturing techniques offer the possibility of relatively easily obtaining a transverse cross-section having an appropriate profile which can be varied longitudinally for obtaining a desired mechanical response characteristics for the ski.

SUMMARY OF THE INVENTION

The present invention relates to improvements to known skis, a particular object of the invention being to facilitate the manufacture of the skis, to lower the cost of manufacture and to very easily maintain the desired mechanical response characteristics of the ski thus manufactured.

To this end, it is an object of the invention to present a process of manufacturing a ski including the following steps:

(a) molding a lower element in the shape of a beam casing;

(b) molding an upper element in the shape of a beam casing;

wherein in the step of molding the lower element, an upper surface is formed that has either a longitudinally extending groove or a longitudinally extending projection and, in the step of molding the upper element, a lower surface is formed that has a groove or a projection that has a transverse cross-section that is respectively complementary to a transverse cross-section of the groove or to a transverse cross-section of the projection of the lower element; and (c) assembling the upper shaped element and the lower shaped element by nesting the groove or projection of the upper element to the projection or groove, respectively, of the upper element.

In a specific embodiment of the invention, in the step of molding the lower element, an upper surface is formed that has a longitudinally extending groove and, in the step of molding the upper element, a lower surface is formed that has a longitudinally extending projection complementary to the longitudinally extending groove of the lower element.

In a specific alternative embodiment, in the step of molding the lower element, an upper surface is formed that has a longitudinally extending projection and, in the step of molding the upper element, a lower surface is formed that has a longitudinally extending groove complementary to the longitudinally extending projection of the lower element.

Similarly, it is an object of the present invention to present a ski which includes:

(a) a lower element having the shape of a beam casing;

(b) an upper element having the shape of a beam casing;

wherein the lower element has an upper surface that has either a longitudinally extending groove or a longitudinally extending projection and the upper element has a lower surface that has a groove or a projection that has a transverse cross-section that is respectively complementary to a transverse cross-section of the groove or to a transverse cross-section of the projection of the lower element, and in which the groove or projection of the lower element is nested in the projection or groove, respectively, of the upper element.

In a specific embodiment of the invention, the lower shaped element has an upper surface having a groove, the upper shaped element has a lower surface having a projection, and the groove of the lower shaped element is engaged and affixed to the projection of the lower surface of the upper shaped element.

Further according to a specific embodiment, the groove of the upper surface of the lower shaped element and the projection of the lower surface of the upper shaped element each have a transverse cross-section in the form of a V.

In a further alternative embodiment of the invention, the groove of the upper surface of the lower shaped element and the projection of the lower surface of the upper shaped element each have a rectangular transverse cross-section.

It is a further object of the present invention to provide a ski including a longitudinally extending rib, the ski formed by at least two unitarily formed longitudinally extending elements, the two unitarily formed longitudinally extending elements including an upper element and a lower element, wherein the upper element includes the rib, wherein the lower element has a lower surface adapted for sliding upon a surface or adapted for having attached thereto a ski sole, and wherein the upper element has a lower configuration which is shaped for complementary engagement with an upper configuration of the lower element.

Still further according to the invention, each of the upper element and the lower element has a hollow interior portion.

According to a particular feature of the invention, depending upon the response characteristics sought for the ski, the hollow interior portion of either or both the upper element and the lower element is filled with a quantity of material. The material can be selected to be either elastic or rigid. Such material could be a synthetic foam, for example.

BRIEF DESCRIPTION OF THE DRAWINGS

Additional advantages, features, and characteristics of the invention will become apparent in the following detailed description of certain non-limiting embodiments of the present invention, which is given with reference to the annexed drawings in which.

DETAILED DESCRIPTION OF PREFERRED EMBODIMENTS

Figures 1, 2, 3, 4, 5, 6, 7:
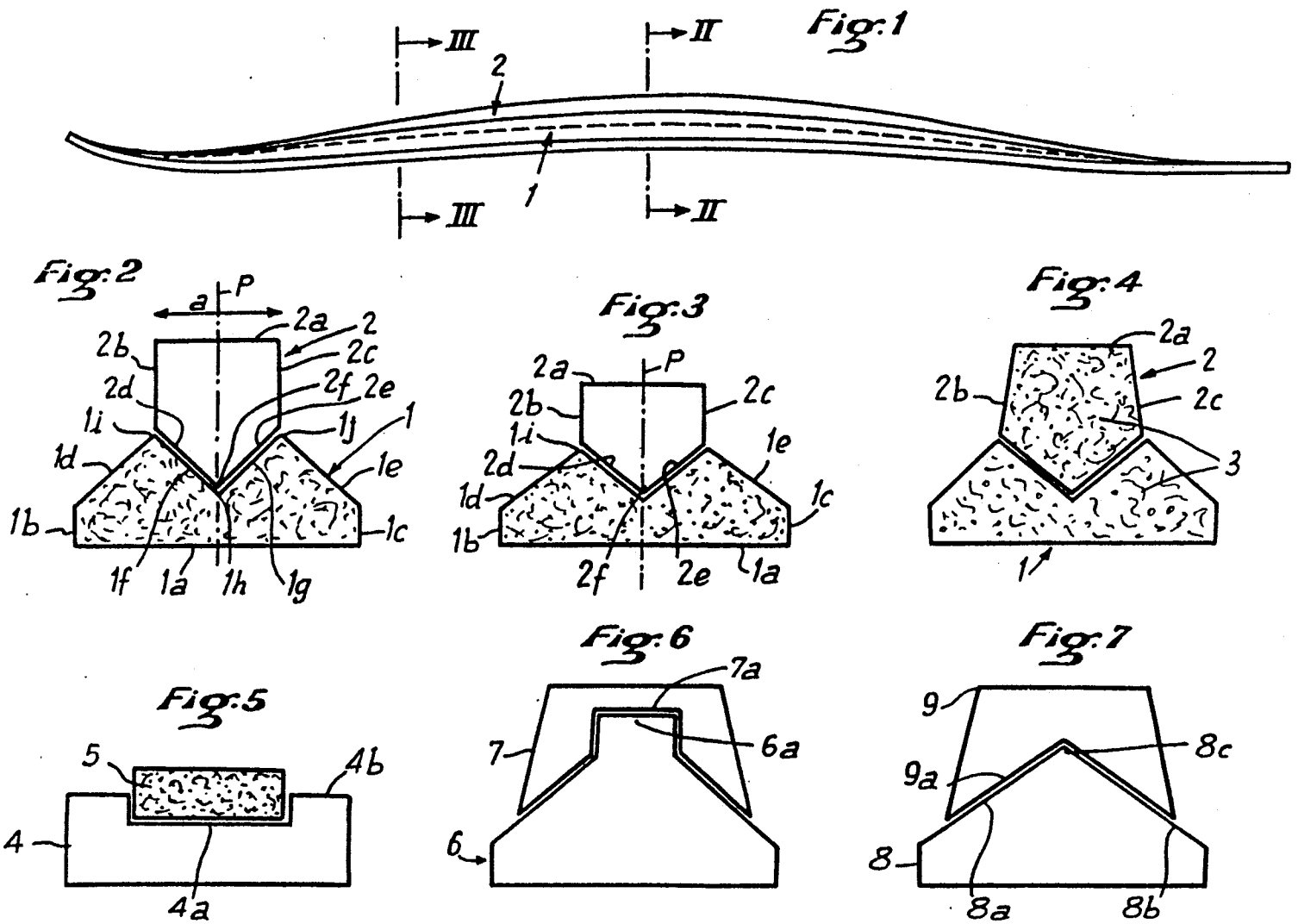
FIG. 1 is a side elevation view of one embodiment of a ski made of plastic material according to the invention.
FIG. 2 is a vertical and transverse cross-sectional view along line II—II of FIG. 1.
FIG. 3 is a vertical and transverse cross-sectional view along line III—III of FIG. 1.
FIGS. 4–7 are transverse cross-sectional views of alternative embodiments of the ski.

The process of manufacture of a ski according to the invention is characterized in that one forms two shaped pieces each having the shape of a beam casing, namely a lower shaped piece and an upper shaped piece, one forms one of the shape pieces in a manner such that it presents, in one of its upper or lower surfaces, a longitudinal groove whose transverse cross-sectional shape corresponds substantially to that of the lower or upper portion of the other shaped element, and one assembles the lower and upper shaped elements by tightly nesting, in the longitudinal groove of the first shaped element, the facing portion, of corresponding shape, of the other shaped element.

The invention likewise has as an object a ski obtained by performing the process of manufacture mentioned above, the ski being characterized in that it is constituted by lower and upper shaped elements, each having the shape of a beam casing, maintained by assembly of a longitudinal rib, provided on one of the shaped elements, nested in a longitudinal groove provided in the other shaped element.

The ski shown in FIGS. 1–3 which can be a cross-country ski or an alpine ski, is constituted by two superimposed shaped elements made of any appropriate material, for example from plastic, each having the shape of a beam casing, namely a lower shaped element 1 and an upper element 2, which are nested in one another Thus, the lower element 1 and the upper element 2 comprise the body of the ski. Each of the two shaped elements 1 and 2 is formed separately, the material constituting the two shaped elements 1 and 2 being the same or different depending upon the applications envisioned. The two shaped elements are then assembled by gluing or welding or any other process. It is thus possible to very easily manufacture skis having different mechanical response characteristics by superimposing on a single type of lower shaped element, common to all of the types of skis, upper shaped elements 2 made of different materials and/or having different transverse cross-sections.

To obtain a good connection between the two shaped elements 1 and 2, and particularly an elevated resistance with respect to shear stresses, the assembly of the two shaped elements 1 and 2 is obtained by nesting of one of the shaped elements in the other. For this purpose, a longitudinal rib on one of the shaped elements is provided which nests in a longitudinal groove provided in the other shaped element and a transverse cross-section of the same shape as that of the rib.

In the non-limiting embodiment shown in FIGS. 1–3, it is the lower shaped element 1 which has, at its upper portion, a longitudinal groove in which is engaged a rib constituted by the lower portion of upper shaped element 2. More particularly, the lower shaped element 1 which has a symmetrical transverse cross-section with respect to the vertical and longitudinal plane of symmetry P of the ski, comprises a lower planar and horizontal wall 1*a* constituting the sole or bottom of the ski, two lateral and vertical walls 1*b* and 1*c* of low height constituting the sides of the ski, and an upper wall having the transverse cross-section of an inverted W shape. This upper wall is thus constituted by two external walls 1*d* and 1*e* which are inclined from top to bottom and from the interior to the exterior of the ski, and by two internal walls 1*f* and 1*g* which are inclined from top to bottom and from the exterior towards the interior of the ski. The internal inclined walls 1*f* and 1*g* of the lower shaped element 1 are connected, at their lower ends, along the length of a longitudinal lower common edge 1*h* contained in the plane P, and at their upper ends, to the two respective external walls 1*d* and 1*e* along the length of the upper respective longitudinal edges 1*i* and 1*j*. The lower shaped element 1 thus has at its upper portion a longitudinal central groove having a transverse cross-section in the form of a V and which is defined by the two inclined walls 1*f* and 1*g*.

As to the upper shaped element 2, it has a transverse cross-section in the form of a pentagon which is symmetrical with respect to the plane P. The upper shaped element 2 comprises an upper horizontal wall 2*a* having a width equal to the distance between the two upper longitudinal edges 1*i* and 1*j* of the lower shaped element 1, two lateral and vertical walls 2*b* and 2*c* extending until the upper edges 1*i* and 1*j* of the lower shaped element, and two inclined lower walls 2*d* and 2*e* connected at the bottom the length of a common lower longitudinal edge 2*f* adjacent to the lower central longitudinal edge 1*h* of the lower shaped element. The upper shaped element 2 thus has, at its lower portion, a groove having a transverse cross-section in the form of a V, which is defined by the two lower inclined walls 2*d* and 2*b* and whose dimensions correspond very closely to those of the groove 1*f* and 1*g* of the lower shaped element 1. Furthermore, the ski in its entirety has, at its upper portion, a rib constituted by the upper portion of the upper shaped element 2 which projects with respect to the lower shaped element and which has a rectangular transverse cross-section.

As can be seen in FIG. 1, the lower shaped element 1 extends over the entire length of the ski while the upper shaped element 2 extends over the major portion of the length and particularly in the "skate" zone of the ski, i.e., at the location where the foot of the skier is supported. The height of each of the two shaped elements 1 and 2 varies in the longitudinal direction, being at a maximum in the central zone of the skate portion of the ski, while being diminished towards the two ends of the ski. The hollow, enclosed beam casings which constitute the shaped elements 1 and 2 can be left empty or can be filled, one or the other or both, with an elastic or rigid material, such as a synthetic foam. In the embodiment shown in FIGS. 1–3, it has been assumed that the lower shaped element 1 alone is filled with a synthetic foam 3, while the upper shaped element 2 is left empty.

FIG. 4 shows an alternative in which the upper shaped element 2 comprises two lateral walls 2*b* and 2*c* which are inclined and converge upwardly, such that the ski has, at its upper portion, a rib constituted by the upper portion of the upper shaped element 2 which has a trapezoidal transverse cross-section. Furthermore, the two shaped elements 1 and 2 of FIG. 4 are filled with a synthetic foam 3.

FIG. 5 illustrates an alternative embodiment in Which the lower shaped element 4 and upper shaped element 5 both have a rectangular transverse cross-section. Thus, the upper element in FIG. 5, like the upper element in FIGS. 2–4, in transverse cross-section, is constituted by an enclosed periphery in the shape of a convex polygon. The upper shaped element 5, of narrower width than that of the lower shaped element 4, is nested in a longitudinal groove 4*a*, of rectangular transverse cross-section of generally the same width as that of the upper shaped element 5, which is formed in the upper wall 4*b* of the lower shaped element 4. As a result, the lower shaped element 4 has the shape of a C which is lying flat so that it is opened upwardly. In this case, the upper shaped element 5 alone is filled with a synthetic foam 3.

FIGS. 6 and 7 illustrate other non-limiting embodiments in which the lower shaped elements have upper ribs which engage in complementary grooves provided in the lower walls of the upper shaped elements.

In the embodiment shown in FIG. 6, the lower shaped element 6 has at its upper portion a rib 6*a* of rectangular transverse cross-section which engages in a groove of the same shape 7*a* which is provided in the lower wall of an upper shaped element 7 of trapezoidal transverse cross-section.

In the embodiment shown in FIG. 7, the lower shaped element 8 has an upper shaped element in the form of a dihedral opened downwardly, constituted by two lateral inclined walls 8*a* and 8*b* connected at the location of an upper common edge 8*c*. Dihedral 8*a*, 8*b*, 8*c* is engaged in a groove 9*a* in the form of an inverted V, of the same dimension, provided in the lower portion of an upper shaped element 9 having a trapezoidal transverse cross-section.

Although the invention has been described with reference to particular means, materials and embodiments, it is to be understood that the invention is not limited to the particulars disclosed and extends to all equivalents within the scope of the claims.

What is claimed is:

1. A ski comprising:

(a) a lower element having the shape of a beam casing;

(b) an upper element having the shape of a beam casing;

wherein the ski has a body comprised of said lower element and said upper element, wherein said lower element has an upper surface that has a longitudinally extending groove and the upper element has a lower surface that has a longitudinally extending projection that has a transverse cross-section that is complementary to a transverse cross-section of said groove of said lower element, wherein said groove of said lower element is engaged and affixed to said projection of the lower surface of said upper element, wherein said upper element extends upwardly beyond said upper surface of said lower element to form a single rib, and wherein said rib has a width less than a width of said lower element.

2. A ski according to claim 1, wherein said groove of said upper surface of said lower shaped element and said projection of said lower surface of said upper shaped element each have a transverse cross-section in the form of a V.

3. A ski according to claim 1, wherein said groove of said upper surface of said lower shaped element and said projection of said lower surface of said upper shaped element each have a rectangular transverse cross-section.

4. The ski of claim 1, wherein each of said upper element and said lower element has a hollow interior portion.

5. The ski of claim 4, wherein said hollow interior portion of said upper element is filled with a quantity of material.

6. The ski of claim 5, wherein said hollow interior portion of said lower element is filled with a quantity of material.

7. The ski of claim 4, wherein said hollow interior portion of said lower element is filled with a quantity of material.

8. The ski of claim 5, wherein said material is selected from a group consisting of elastic material and rigid material.

9. The ski of claim 6, wherein said material is selected from a group consisting of elastic material and rigid material.

10. The ski of claim 7, wherein said material is selected from a group consisting of elastic material and rigid material.

11. The ski of claim 5, wherein said material is synthetic foam.

12. The ski of claim 6, wherein said material is synthetic foam.

13. The ski of claim 7, wherein said material is synthetic foam.

14. The ski of claim 1, wherein said rib has side walls and said lower element has side walls, and wherein said side walls of said rib are distinct from said side walls of said lower element.

15. The ski of claim 1, wherein said longitudinally extending groove in said upper surface of said lower element comprises a single groove in said upper surface of said lower element and wherein said projection of said lower surface of said upper element comprises a single projection of said lower surface of said upper element.

16. The ski of claim 1, wherein said lower element has a predeterminate width and said upper element has a width that is less than said predeterminate width.

17. The ski of claim 1, wherein said upper element has a transverse cross-section comprising a closed convex periphery.

18. The ski of claim 1, wherein said upper element has a transverse cross-section in the form of a convex polygon.

19. The ski of claim 18, wherein said convex polygon is a pentagon.

20. The ski of claim 18, wherein said convex polygon is a quadrilateral.

21. The ski of claim 20, wherein said quadrilateral is a rectangle.

22. A ski comprising a longitudinally extending rib, said ski formed by at least two unitarily formed longitudinally extending elements, said two unitarily formed longitudinally extending elements comprising an upper element and a lower element, wherein said upper element comprises said rib, wherein said lower element has a lower surface, wherein said upper element has a lower configuration which is shaped for complementary engagement with an upper configuration of said lower element, wherein said upper element has a longitudinally and downwardly extending projection, wherein said lower element has a longitudinally and upwardly facing groove, wherein said projection of said upper element is engaged within said groove of said lower element and extends upwardly beyond said lower element, and wherein said rib of said upper element constitutes a single rib of said ski.

23. The ski of claim 22, wherein said lower surface of said lower element is exposed for sliding upon a surface.

24. The ski of claim 22, further comprising a sole attached to said lower surface of said lower element.

25. A ski comprising a longitudinally extending rib, said ski formed by at least two unitarily formed longitudinally extending elements, said two unitarily formed longitudinally extending elements comprising an upper element and a lower element, wherein said upper element comprises said rib, wherein said lower element has a lower surface, wherein said upper element has a lower configuration and said lower element has an upper configuration, wherein lower configuration of said upper element is engaged with said upper configuration of said lower element, wherein each of said upper element and said lower element has a hollow interior portion, wherein said hollow interior portion of said upper element is filled with a quantity of material, and wherein said hollow interior of said lower element is empty.

26. The ski of claim 25, wherein said material is selected from a group consisting of elastic material and rigid material.

27. The ski of claim 25, wherein each of said upper element and said lower element has an enclosed periphery and wherein said lower configuration of said upper element comprises a lower configuration of an enclosed periphery of said upper element and said upper configuration of said lower element comprises an upper configuration of an enclosed periphery of said lower element.

28. A ski comprising a longitudinally extending rib, said ski formed by at least two unitarily formed longitudinally extending elements, said two unitarily formed longitudinally extending elements comprising an upper element and a lower element, wherein said upper element comprises said rib, wherein said lower element has a lower surface, wherein said upper element has a lower configuration which is shaped for complementary engagement with an upper configuration of said lower element, wherein each of said upper element and said lower element has a hollow interior portion, wherein said hollow interior portion of said lower element is filled with a quantity of material, and wherein said hollow interior of said upper element is empty.

29. The ski of claim 28, wherein said material is selected from a group consisting of elastic material and rigid material.

30. The ski of claim 25, wherein said material is synthetic foam.

31. The ski of claim 28, wherein said material is synthetic foam.

32. The ski of claim 25, wherein said lower surface of said lower element is exposed for sliding upon a surface.

33. The ski of claim 25, further comprising a sole attached to said lower surface of said lower element.

34. The ski of claim 28, wherein said lower surface of said lower element is exposed for sliding upon a surface.

35. The ski of claim 28, further comprising a sole attached to said lower surface of said lower element.

36. A ski comprising a longitudinally extending rib, said ski formed by at least two unitarily formed longitudinally extending elements, said two unitarily formed longitudinally extending elements comprising an upper element and a lower element, wherein said upper element comprises said rib, wherein said lower element has a lower surface, wherein said upper element has a lower configuration which is shaped for complementary engagement with an upper configuration of said lower element, and wherein each of said upper element and said lower element has a hollow enclosed interior portion.

37. The ski of claim 36, wherein at least one of said upper element and said lower element has a filling within said hollow enclosed interior portion thereof.

* * * * *